US005678574A

United States Patent [19]

Huang et al.

[11] Patent Number: 5,678,574

[45] Date of Patent: Oct. 21, 1997

[54] CIGARETTE PUNCHING DEVICE

[76] Inventors: Min-Tsung Huang, No. 115, Street 19, Ta-Tun, Taichung; Chih-Chen Chang, No. 45, Min-Der Hsin Village, Tsuo Ying Area, Kaoshiung, both of Taiwan

[21] Appl. No.: 666,261

[22] Filed: Jun. 20, 1996

[51] Int. Cl.[6] ..... A24F 47/00; A24F 13/24

[52] U.S. Cl. ..... 131/255; 131/253; 131/281

[58] Field of Search ..... 131/253, 255, 131/281

[56] References Cited

U.S. PATENT DOCUMENTS

| | | | |
|---|---|---|---|
| 474,793 | 5/1892 | Castro | 131/255 |
| 738,540 | 9/1903 | Hopkins | 131/255 |
| 4,231,378 | 11/1980 | Stevens | 131/253 |

FOREIGN PATENT DOCUMENTS

| | | | |
|---|---|---|---|
| 17383 | of 1889 | United Kingdom | 131/255 |
| 6250 | of 1893 | United Kingdom | 131/255 |
| 30411 | of 1897 | United Kingdom | 131/255 |

*Primary Examiner*—Jennifer Bahr
*Attorney, Agent, or Firm*—Browdy and Neimark

[57] ABSTRACT

A cigarette punching device comprises a first housing member, a second housing member fitted into the first housing member, a punching device, a receiving cylinder, and an elastic element. The first housing member is provided with a through hole. The second housing member is provided with a front receiving compartment, a rear receiving compartment, and a partition located between the from and the rear receiving compartments. The punching device is received in the rear receiving compartment of the second housing member such that the punching needle of the punching device is located in the front receiving compartment. The receiving cylinder is located in the first housing member via the through hole of the first housing member for holding a cigarette to be punched. The elastic element is located between the first and the second housing members to provide the second housing member with an elastic force enabling the second housing member to bounce back to its original position. The punching of the cigarette is brought about by the compression motion of the second housing member in relation to the first housing member.

7 Claims, 4 Drawing Sheets

CIGARETTE PUNCHING DEVICE

FIELD OF THE INVENTION

The present invention relates generally to a cigarette punching device, and more particularly to a portable and safe device for punching a single cigarette.

BACKGROUND OF THE INVENTION

There are various ways and means for helping the chronical smokers, especially the chain smokers, to kick the habit. One of the methods for kicking the habit is the so-called "going cold turkey", which calls for the abrupt and total withdrawal of an addict from tobacco. However, such a method as described above is, in fact, ineffective at best, in view of the fact that nicotine contained in the tobacco leaves is a habit-forming alkaloid.

A cigarette punching device disclosed in the Taiwanese Patent Serial No. 84204597 comprises a housing of a square construction. The housing is dimensioned to receive therein a pack of cigarettes and is provided therein with a plurality of punching needles for punching the filter tips of the cigarettes contained in the housing. In addition, the punching device is provided with a safety plate for preventing the punching needles at work from inflicting a wound on the fingers of a person doing the punching work.

Such a prior art cigarette punching device as described above is defective in design in that it can not be carried around easily, and that all cigarettes in the pack are punched at the same time, thereby resulting in an occasional inconvenience at such time when an unpunched cigarette is needed for one reason or another.

SUMMARY OF THE INVENTION

It is therefore the primary objective of the present invention to provide a cigarette punching device capable of punching the filter tip of a single cigarette one by one.

It is another objective of the present invention to provide a cigarette punching device which is compact and can be therefore carried around easily.

It is still another objective of the present invention to provide a cigarette punching device which is easy to use and is provided with a safety device for preventing the bodily injury inflicted on a person doing the punching work.

In keeping with the principle of the present invention, the foregoing objectives of the present invention are attained by a portable cigarette punching device, which comprises a first housing member, a second housing member, a punching device, a receiving cylinder, and an elastic member. The first housing member is of a cylindrical construction and is provided in one side thereof with a through hole. The second housing member is fitted into the hollow interior of the first housing member and is provided in the hollow interior thereof with two receiving compartments which are separated with a partition. The punching device is located in the rear compartment of the second housing member such that a punching needle of the punching device is received in the front compartment of the second housing member. The receiving cylinder is received in the first housing member via the through hole of the first housing member such that the receiving cylinder can be caused to rotate by an external force exerting thereon. The receiving cylinder is intended to hold a single cigarette to be punched. The elastic member is located between the first housing member and the second housing member for providing the second housing member with an elastic force enabling the second housing member to return to its original position. The second housing member is capable of a compressive motion in relation to the first housing member so as to cause the punching needle to punch the filter tip of a cigarette which is held in the receiving cylinder.

The foregoing objectives, features, functions, and advantages of the present invention will be more readily understood upon a thoughtful deliberation of the following detailed description of a preferred embodiment of the present invention in conjunction with the accompanying drawings.

DETAILED DESCRIPTION OF THE INVENTION

Figure 1:
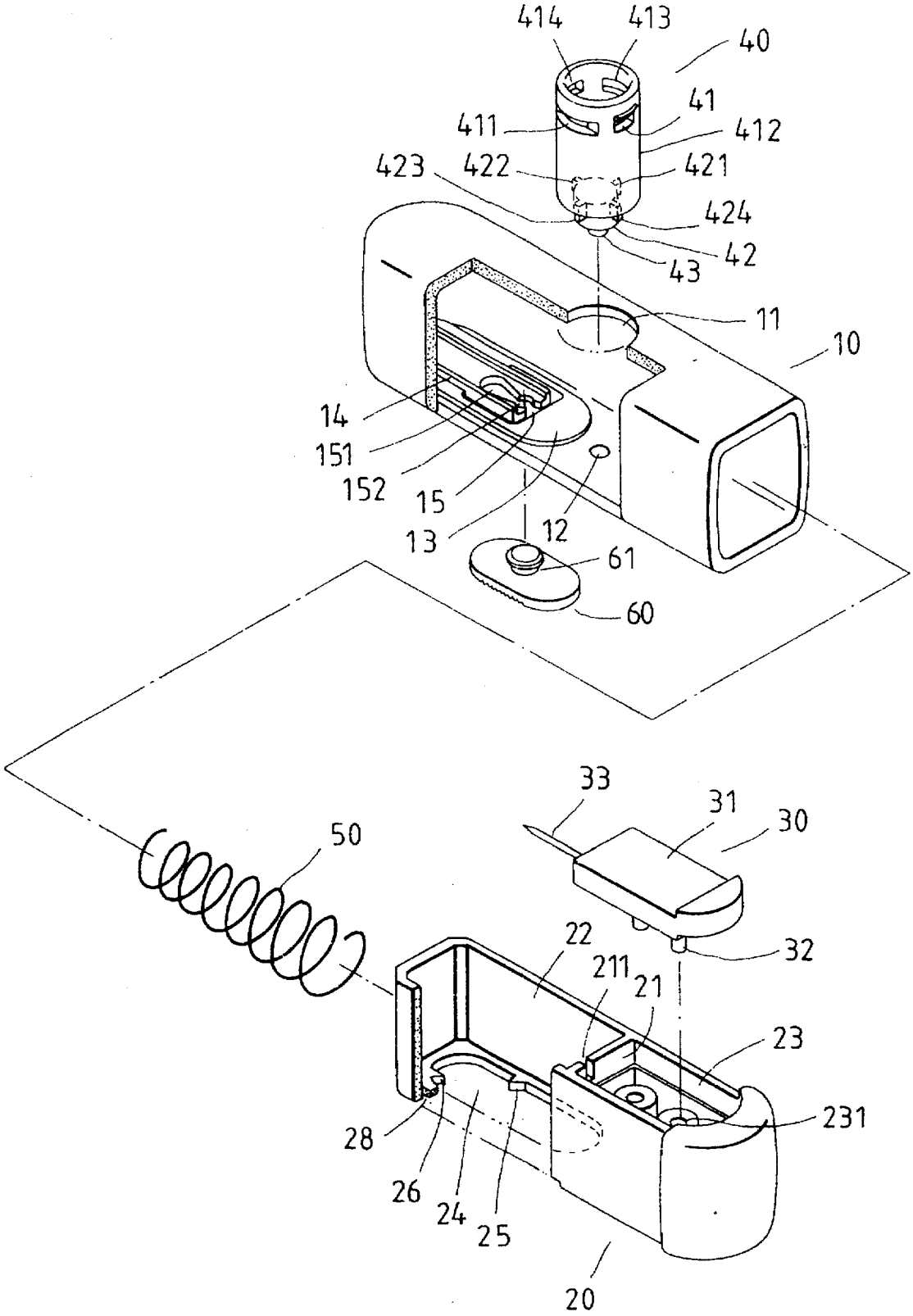
FIG. 1 shows an exploded view of a cigarette punching device of the preferred embodiment of the present invention.
Figure 2:
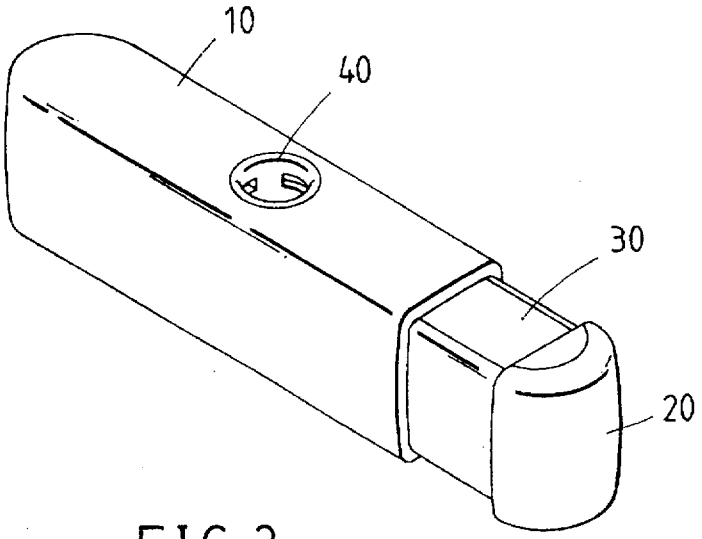
FIG. 2 shows a perspective view of the cigarette punching device in combination according to the present invention.

As shown in FIGS. 1 and 2, a cigarette punching device embodied in the present invention is composed of the component parts which are described explicitly hereinafter.

Figure 3:
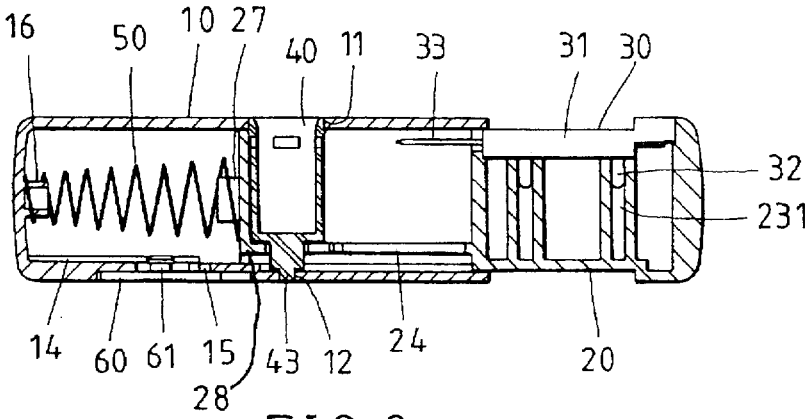
FIG. 3 shows a longitudinal sectional view of the cigarette punching device of the present invention.

A first housing member 10 of a hollow construction is provided at the center of the top wall thereof with a through hole 11, and at the center of the bottom wall thereof with a locating hole 12 corresponding in location to the through hole 11. Located in the rear segment of the bottom of the first housing member 10 is a base plate 13 which is provided thereon with two guide rails 14 extending in the direction of the longitudinal axis of the base plate 13 such that guide rails 14 are parallel to each other. The first housing member 10 is further provided in the bottom thereof with a through space 15 corresponding in location to the front end areas of the guide rails 14. The through space 15 has a receiving area 151 extending toward the center of the guide rails 14. The receiving area 151 is provided at the front edge thereof with a position restricting ring 152 having a diameter smaller than that of the receiving area 151. As a result, the front ends of two parallel guide rails 14 can be caused by the position restricting ring 152 to expand and deform. As shown in FIG. 3, the first housing member 10 is further provided in the inner wall surface thereof with a fitting projection 16 located at one end thereof.

A second housing member 20 of a rectangular construction is dimensioned to fit into the hollow interior of the first housing member 10 and is provided therein with two receiving compartments 22 and 23 having an open top and a partition 21 located therebetween. The partition 21 is provided in one side thereof with a guide groove 211. The rear receiving compartment 23 is provided therein with two upright tubes 231 perpendicular to the bottom wall of the second housing member 20. The front receiving compartment 22 is provided in the bottom wall thereof with an oblong slot 24 which is provided in the long side walls thereof with two moving blocks 25 and 26. As shown in FIG. 3, the second housing member 20 is further provided at the front edge thereof with a locating projection 27. As further shown in FIG. 1 at the center of the front segment of the bottom thereof is provided with a stepped surface which is in turn provided respectively on both sides thereof with a stepped area 28.

A punching device 30 has a plate piece 31 which is provided in the underside thereof with two insertion projections 32 engageable with the tubes 231 of the second housing member 20. The plate piece 31 is provided by one side of the front end thereof with a punching needle 33, which is received in the front receiving compartment 22 of the second housing member 20 via the guide groove 211 of the partition 21.

A receiving cylinder 40 is disposed in the first housing member 10 such that the longitudinal axis of the receiving cylinder 40 is perpendicular to the bottom wall of the first housing member 10. The receiving cylinder 40 is composed of three round steps 41, 42 and 43. The upper round step 41 is engaged in the through hole 11 of the first housing member 10 and is provided in the periphery of the top end thereof with four through slots 411, 412, 413 and 414. The middle round step 42 is provided in the periphery thereof with four protuberances 421, 422, 423 and 424, which are corresponding in location to four through slots 411, 412, 413 and 414. The lower round step 43 is located in the locating hole 12 of te first housing member 10.

A spring 50 is located between the first housing member 10 and the second housing member 20 for providing the second housing member 20 with an elastic force enabling the second housing member 20 to return to its original position.

A safety member 60 is arranged in the through space 15 of the first housing member 10 and is provided with a projection 61 engageable with the receiving area 151 in such a manner that the projection 61 can be caused by an external force exerting on the safety member 60 to move back and forth along the direction of the longitudinal axis of the receiving area 151.

Figure 4:
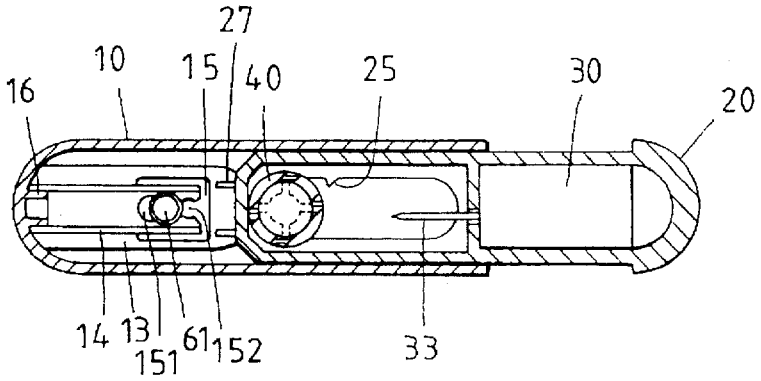
FIG. 4 shows a horizontal sectional view of the cigarette punching device of the present invention.

In combination, the safety member 60 is first engaged with the receiving area 151 of the through space 15 of the first housing member 10 such that the projection 61 of the safety member 60 is completely engaged with the tail end of the receiving area 151, as shown in FIGS. 3 and 4. Thereafter, the spring 50 is disposed in such a manner that the fitting projection 16 of the first housing member 10 is urged by one end of the spring 50. The second housing member 20 is then fitted into the hollow interior of the first housing member 10 such that the locating projection 27 is urged by another end of the spring 50. In the meantime, the receiving cylinder 40 is located in the front receiving compartment 22 of the second housing member 22 such that the receiving cylinder 40 is perpendicular to the bottom wall of the front receiving compartment 22, and that the receiving cylinder 40 prevents the second housing member 20 from slipping out of the first housing member 10.

Figure 5:
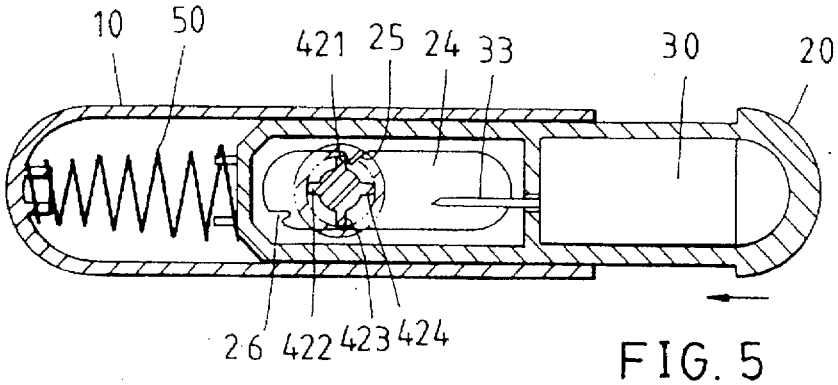
FIGS. 5–9 are schematic views illustrating the continuous punching actions of the cigarette punching device of the present invention at work.
Figure 6:
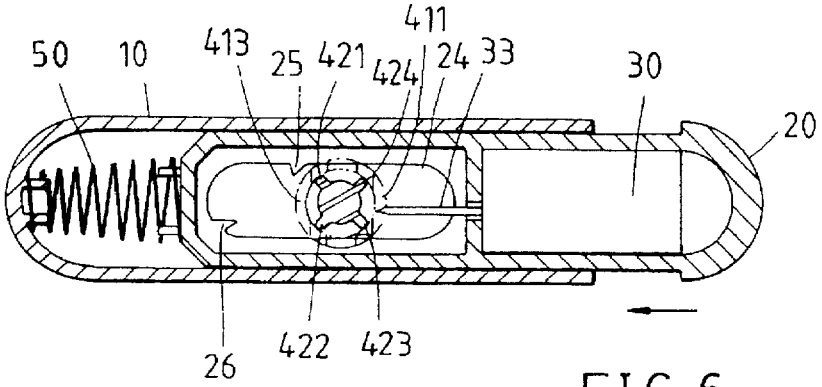
Figure 7:
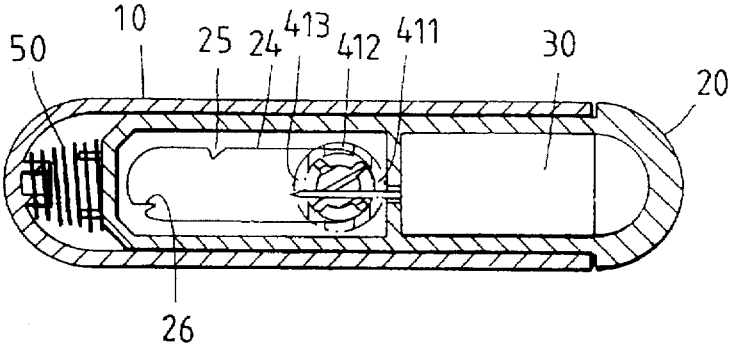
Figure 8:
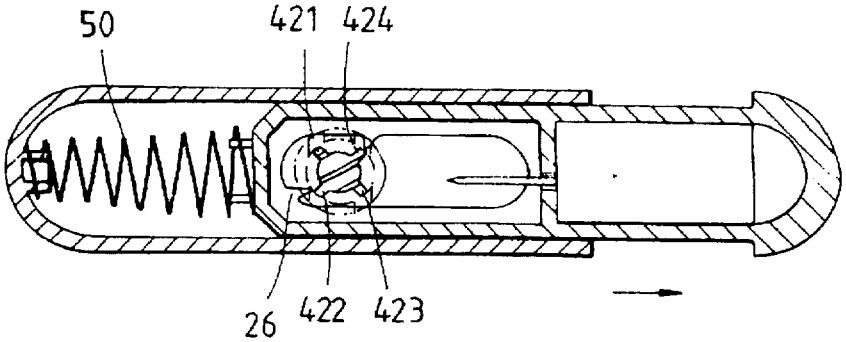
Figure 9:
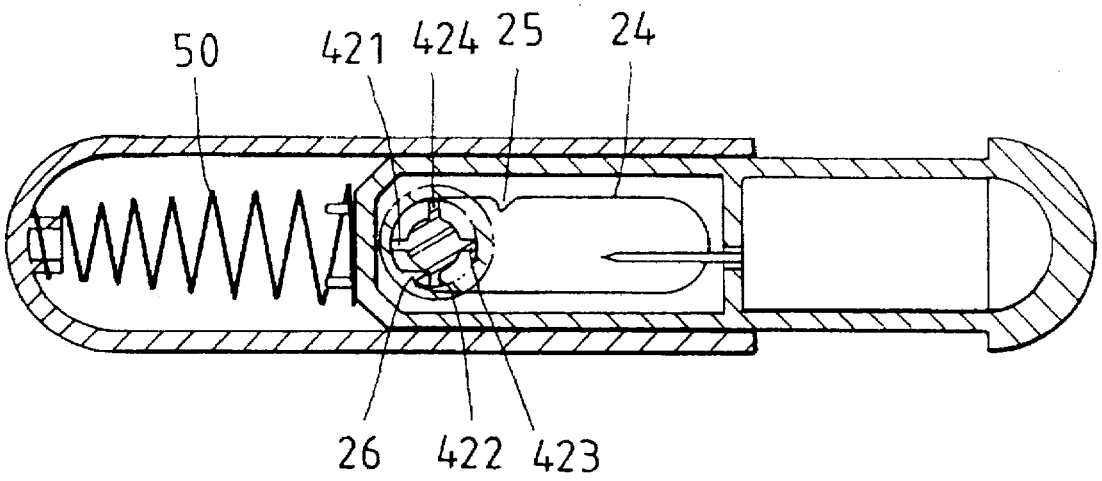

In operation, a cigarette filter tip to be punched is placed in the axial hole of the receiving cylinder 40 before the second housing member 20 is pushed with finger toward the first housing member 10 such that the first moving block 25 is pushed to force the first protuberance 421 of the receiving cylinder 40 to move, as shown in FIG. 5. As a result, the receiving cylinder 40 is actuated by the first protuberance 421 in motion to make a 45-degree rotation, as shown in FIG. 6. The punching needle 33 of the punching device 30 is then caused by the advancing motion of the second housing member 20 to pass through the first through slot 411 of the receiving cylinder 40 so as to punch horizontally two holes in the cigarette filter tip, as shown in FIG. 7. In the meantime, the spring 50 is compressed fully. As the energy is released by the compressed spring 50, the second housing member 20 is forced to move in the direction away from the first housing member 10, thereby causing the punching needle 33 to disengage the cigarette filter tip, as shown in FIG. 8. Subsequently, the second protuberance 422 of the receiving cylinder 40 is actuated by the second moving block 26 of the second housing member 20 to make a counterclockwise 45-degree rotation. As a result of the previously described rotations of the first protuberance 421 and the second protuberance 422, the receiving cylinder 40 has completed a 90-degree spin. The punching process described above may be repeated so as to punch three, four or even eight holes in the cigarette filter tip for reducing further the nicotine or tar content in the smoke.

Figure 10:
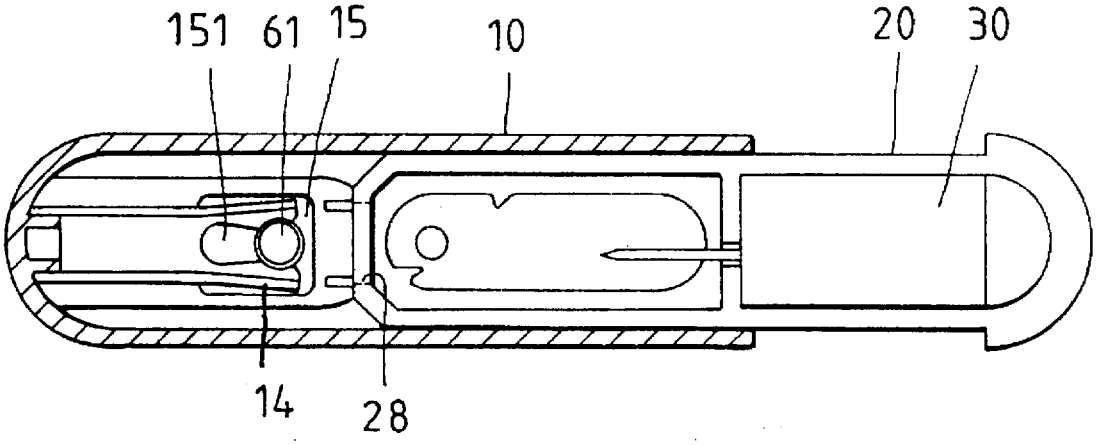
FIG. 10 is another sectional view showing a safety feature capable of preventing the second housing member from being activated at such time when the cigarette punching device of the present invention is turned OFF.

As shown in FIG. 10, the safety member 60 of the cigarette punching device of the present invention is intended to prevent the punching needle 33 of the punching device 30 from punching the fingers of a user. When the safety member 60 is pushed forward into the position restricting ring 152 of the receiving area 151 of the first housing member 10, the stepped area 28 of the second housing member 20 is engaged and the guide rails 14 expanded outward as shown in FIG. 10 by the guide rails 14, thanks to the projection 61 of the safety member 60 positioned in restricting ring 152. The punching needle 33 is therefore prevented from entering in the receiving cylinder 40.

The cigarette punching device of the present invention has inherent advantages in that it is compact and can be carded around easily, and that it is simple in construction and composed of less component parts for easy assembly, and further that it can be used handily by a smoker for reducing effectively the nicotine or tar content of the cigarette, and still further that it is safe to use.

The embodiment of the present invention described above is to be regarded in all respects as being merely illustrative and not restrictive. Accordingly, the present invention may be embodied in other specific forms without deviating from the Spirit thereof. The present invention is therefore to be limited only by the scopes of the following appended claims.

What is claimed is:

1. A cigarette punching device comprising:

a first housing member having a hollow interior construction and provided in one side thereof with a through hole;

a second housing member slidably engaged in the hollow interior construction of said first housing member and having a front receiving compartment, a rear receiving compartment, and a partition located between said front receiving compartment and said rear receiving compartment, said front receiving compartment and said rear receiving compartment having an open top;

a punching device provided with a punching needle and located in said rear receiving compartment of said second housing member such that said punching needle is received in said front receiving compartment of said second housing member;

a receiving cylinder rotatably engaged in said first housing member via said through hole of said first housing member, rotating means on said receiving cylinder and said second housing member for rotating said receiving cylinder when said second housing member is slid into said first housing member, said receiving cylinder being capable of holding therein a single cigarette to be punched; and an elastic element located between said first housing member and said second housing member for providing said second housing member with an elastic force enabling said second housing member to bounce back to an original position of said second housing member after said second housing member had been slid into said first housing member.

2. The cigarette punching device as defined in claim 1, wherein said first housing member is provided in a top wall thereof with said through hole, and in a bottom wall thereof with a locating hole corresponding in location to said through hole; and wherein said receiving cylinder is composed of an upper round step, a middle round step and a lower round step, with said upper round step being engaged with said through hole of said first housing member, and with said lower round step being located in said locating hole, said receiving cylinder being received in said first housing member such that a longitudinal axis of said receiving cylinder is perpendicular to said bottom wall of said first housing member.

3. The cigarette punching device as defined in claim 1, wherein said partition of said second housing member is provided with a guide groove; wherein said rear receiving compartment is provided therein with two upright tubes; and wherein said punching device has a plate piece having two insertion projections engageable with said two upright tubes of said rear receiving compartment, said plate piece further having in one side of a front end thereof a punching needle which is received in said front receiving compartment via said guide groove of said partition.

4. The cigarette punching device as defined in claim 1, wherein said first housing member is provided in an inner wall of one end thereof with a fitting projection; wherein said second housing member is provided in a front edge thereof with a locating projection; and wherein said elastic element is a compression spring having one end urging said fitting projection of said first housing member, said compression spring further having another end urging said locating projection of said second housing member.

5. The cigarette punching device as defined in claim 1, wherein said rotating means comprises an oblong slot in a bottom wall of said front receiving compartment of said second housing member, said oblong slot having respectively on both long sides thereof a moving block, a plurality of protuberances on a periphery of said receiving cylinder aligned in said oblong slot with each said moving block, wherein each said moving block alternatively engages one of said plurality of protuberances when said second housing member is slid into said first housing member to rotate said receiving cylinder relative to said first housing member.

6. The cigarette punching device defined in claim 5, wherein said first housing member is provided in a top wall thereof with said through hole, and in a bottom wall thereof with a locating hole corresponding in location to said through hole; wherein said receiving cylinder is composed of an upper round step, a middle round step and a lower round step, with said upper round step being engaged with said through hole of said first housing member, and with said lower round step being located in said locating hole, said receiving cylinder being received in said first housing member such that a longitudinal axis of said receiving cylinder is perpendicular to said bottom wall of said first housing member; and wherein said plurality of protuberances are on a periphery of said middle round step of said receiving cylinders.

7. The cigarette punching device as defined in claim 1, wherein said first housing member is provided in a rear segment of said bottom wall with two parallel guide rails extending in the direction of a longitudinal axis of said first housing member, said first housing member further provided in said bottom wall with a through space along a periphery of front ends of said guide rails, said through space having a receiving area and a position restricting ring, a safety member having a circular projection slidably located in said through space said position restricting ring having a diameter smaller than a diameter of said projection of said safety member such that said projection can be moved along the direction of a longitudinal axis of said through space by an external force into said position restricting ring to preclude said punching needle from moving through said receiving cylinder.

* * * * *